US005204646A

United States Patent [19]

Fleming-Dahl

[11] Patent Number: 5,204,646

[45] Date of Patent: Apr. 20, 1993

[54] ELECTROMECHANICAL SWITCHES WITH SEGMENTED COILS

[75] Inventor: Arthur Fleming-Dahl, Miller Place, N.Y.

[73] Assignee: Grumman Aerospace Corporation, Bethpage, N.Y.

[21] Appl. No.: 778,262

[22] Filed: Oct. 17, 1991

[51] Int. Cl.[5] ..... H01H 51/22

[52] U.S. Cl. ..... 335/78; 335/138

[58] Field of Search ..... 335/78-86, 335/124, 128, 131-133, 138

[56] References Cited

U.S. PATENT DOCUMENTS

| | | | |
|---|---|---|---|
| 2,335,382 | 11/1943 | Bonanno | 335/80 |
| 4,370,530 | 1/1983 | Wayland | 200/144 B |
| 4,535,291 | 8/1985 | Lee et al. | 324/320 |

*Primary Examiner*—Lincoln Donovan

*Attorney, Agent, or Firm*—Pollock, Vande Sande & Priddy

[57] ABSTRACT

A segmented coil has individual segments mounted on a common electromechanical switch plunger. The e.m.f. developed by the coil segments are superposed so that a reduced input voltage, relative to a continuous single coil, is capable of translating the plunger between two oppositely situated sets of switch contacts. The segmented coil structure assumes the same wire thickness as that of a prior art continuous coil operating with an input voltage of greater value. The result is retention of a small switch package for reduced voltage levels due to the fact that coil wire diameter and the number of turns may be kept the same as for a continuous coil operating with a higher voltage.

2 Claims, 2 Drawing Sheets

ELECTROMECHANICAL SWITCHES WITH SEGMENTED COILS

FIELD OF THE INVENTION

The present invention relates to switches and more particularly to coil structures of solenoid type switches.

BACKGROUND OF THE INVENTION

In a number of electrical design situations, available electromechanical switches present problems due to specification limits of these switches. For example, in order for switch operation to be reliable a certain number of turns must exist and carry a predetermined current so that a current-turn product may be realized which corresponds to the necessary electromagnetic force (e.m.f.) for achieving mechanical switching motion. To obtain a larger e.m.f. the turns may be increased but this adversely affects the compact size of a switch. Alternatively, a larger value of current may be carried by the coils. However, this requires a coil wire of enlarged diameter which again results in a larger dimension for the switch package. Since the mentioned reductions of many electromechanical components such as switches is highly desirable, solutions must be found to avoid larger wire diameters or number of turns.

BRIEF DESCRIPTION OF THE PRESENT INVENTION

The present invention utilizes a segmented coil which is physically located on a solenoid surrounding an electromechanical switch plunger. The various coil segments are energized in parallel to superpose forces developed electromagnetically from a product of a number of coil segment turns and currents.

By employing a segmented coil design the wire diameter may be minimized for a reasonable current level. Otherwise stated, by utilizing a segmented coil electromagnetic switch, reliable switch action may take place in a smaller package than would be possible for a single coil due to the fact that in the latter situation a larger package becomes necessary because a greater number of turns or greater coil wire thickness is employed.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
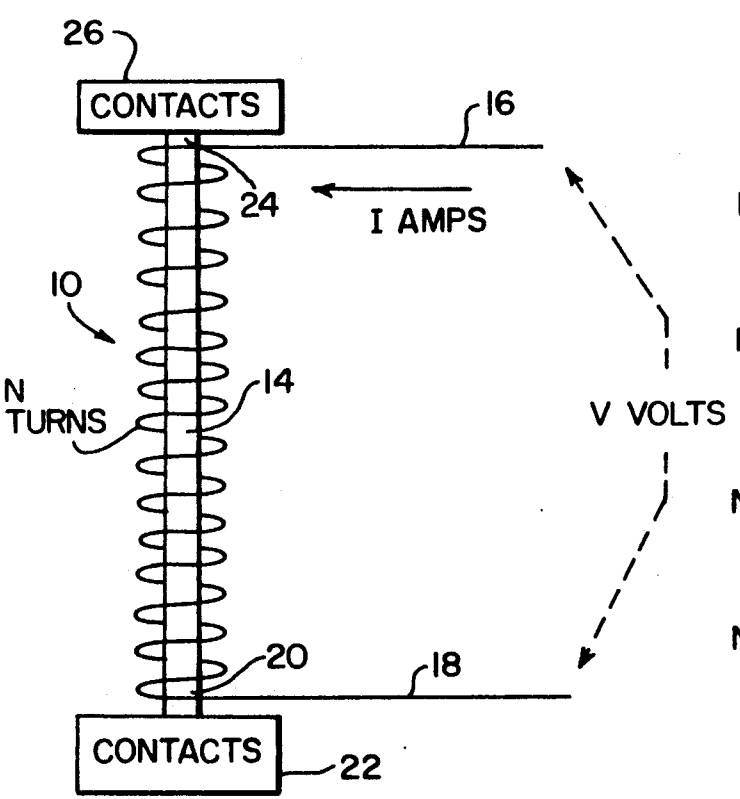
FIG. 1 PRIOR ART
FIG. 1 is a diagrammatic representation of a prior art coil structure as employed in electromechanical switches.

Prior to a discussion of the particular details concerning the present invention it is useful to refer to FIG. 1 wherein a prior art coil structure for operation a mechanical switch mechanism is indicated. The coil is generally indicated by reference numeral 10 and is seen to include a straight continuous coil having N turns, the coil being mounted on a solenoid surrounding displaceable plunger 14. The terminals 16 and 18 connect a voltage across the coil, in FIG. 1 the voltage being generally indicated as V volts. The illustrated upper and lower ends 24 and/or 20, of the plunger are connected to corresponding switch contacts 26 and/or 22. In the case of a pre-magnetized plunger, reversal of input voltage polarity will cause an opposite linear displacement of plunger 14 which causes a different state of connection for contacts 22, 26 thereby effecting differing switch states.

In the case of a non-magnetized, magnetically susceptible plunger, the arrangement will normally include a failsafe mechanism, such as a spring, to force the plunger to a pre-determined position in the absence of an actuating voltage, which is the first switch state. The application of an actuating voltage causes a linear displacement of the plunger, thereby effecting a second switch state. For such a non-magnetized plunger, reversal of the actuating voltage polarity results in an identical linear displacement of the plunger, effecting the previously mentioned second switch state.

Figure 2:
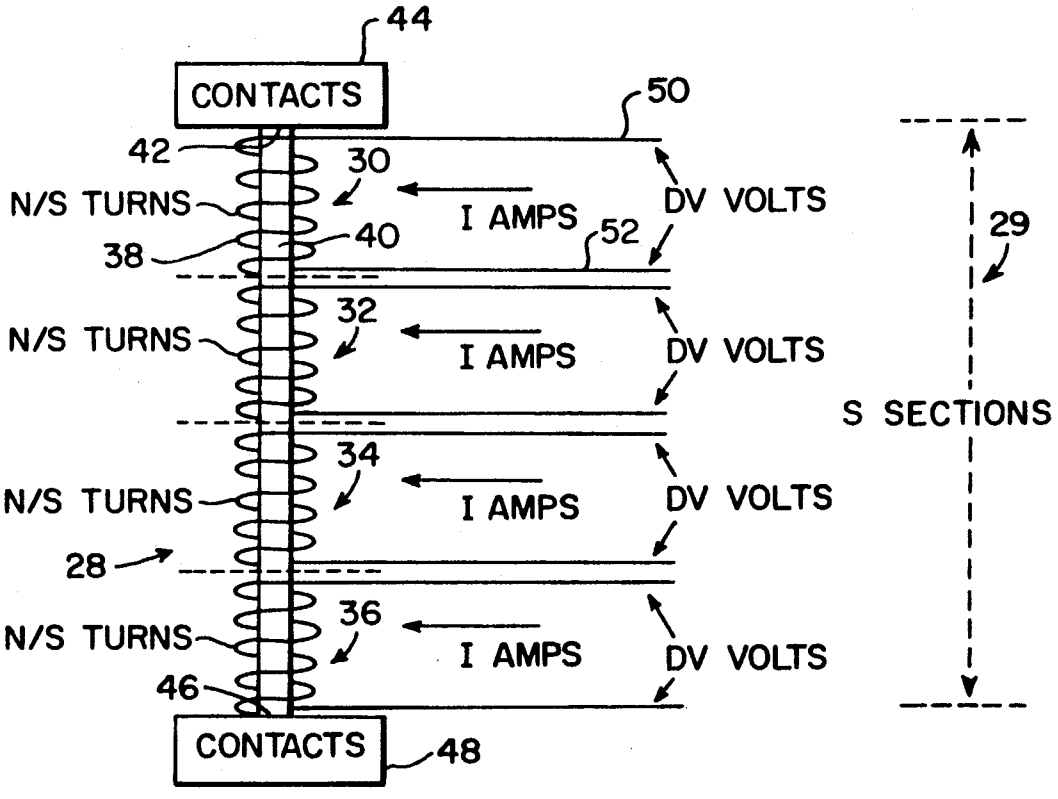
FIG. 2 is a diagrammatic illustration of the present segmented coil structure.

FIG. 2 indicates a basic form of the present invention wherein a voltage supply of reduced voltage may be employed to develop a sufficient e.m.f. so as to allow translational movement of a switch plunger. In order to accomplish this, the present invention utilizes a segmented coil generally indicated by reference numeral 28. The number of segments or sections is generally indicated by reference numeral 29 as "S". In the simplified situation shown in FIG. 2, the number of segments or sections is seen to be four and are individually indicated by reference numerals 30, 32, 34, and 36. Each section has its own coil segment such as 38, which is separate from the remaining coil segments. However, all of the coil segments are mounted in coaxially spaced relation to a single plunger 40. As in the case of the prior art, the outward ends 42 and/or 46 of the plunger are connected to corresponding contacts 44 and/or 48 so that the switch state may be toggled, depending on either the presence or polarity of the input voltages, depending on the plunger construction. Each segmented coil such as 38 has terminals such as 50, 52.

FIG. 2 illustrates the desired input voltage DV to each segment as being $DV=V/S$ volts wherein V volts represents the voltage level employed in the prior at switch of FIG. 1 and S is the number of individual sections. It should be noted that the input voltage to all sections is the same; and the current drawn by each coil segment is the same as that drawn by the entire coil in the prior art construction previously discussed in connection with FIG. 1.

The number of turns in each coil segment is represented by N/S wherein N represents the number of windings present in the single continuous coil of the prior art embodiment of FIG. 1.

The significant advantage of the segmented coil shown in FIG. 2 resides in the fact that the e.m.f. of each coil segment is superposed with those of the other segments so that a total e.m.f. is generated equaling that of the e.m.f. of the prior art embodiment shown and discussed in connection with FIG. 1. This allows the segmented coil of the present invention to operate satisfactorily with a voltage source of reduced level. Further, since each coil segment can operate with the same current I as was the case in connection with FIG. 1, the diameter of the coil wire will remain the same as that of FIG. 1, and thus the switch housing or package requires no additional space. Thus, the result obtained with the present invention is a reliable electromechanical switch capable of operating with lower voltage levels but obviating the necessity of more coil turns or coil wire of increased diameter.

Figure 3:
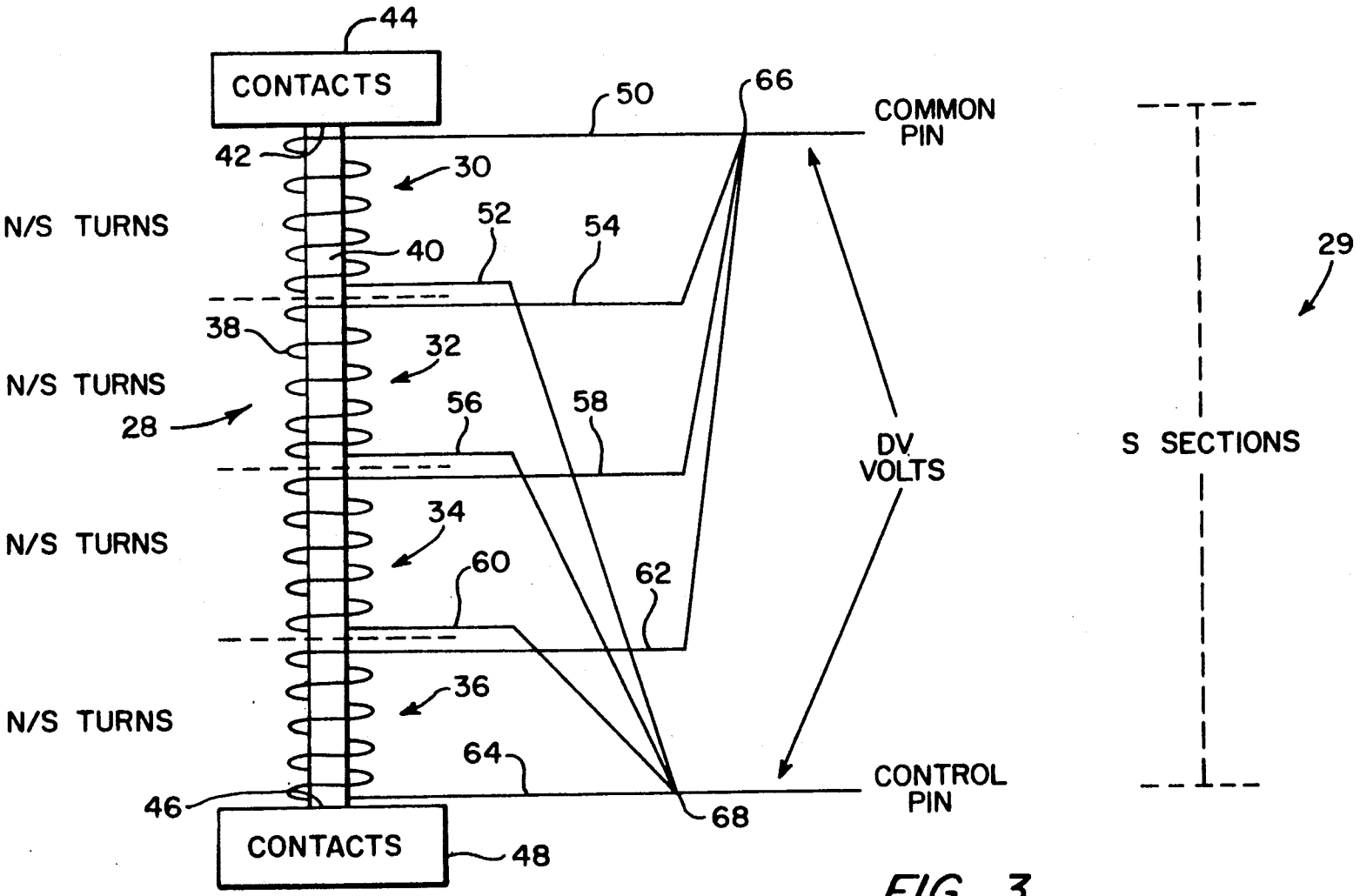
FIG. 3 is a diagrammatic illustration similar to that of FIG. 2 but indicates common pin and control pin connections for all segments.

FIG. 3 represents the same invention as shown in FIG. 2 with the additional requirement of a common pin 66 connected in parallel to corresponding upper terminals 50, 54, 58, and 62 of the various coil segments. Similarly, a control pin 68 is connected in parallel to the lower terminals 52, 56, 60, and 64 of the coil segments. The reduced desired voltage DV is applied between the common pin 66 and the control pin 68. Depending upon the polarity of the applied voltage, a pre-magnetized plunger 40 will translate upwardly or downwardly causing the associated switch to enter a new state. A non-magnetized, magnetically susceptible plunger will translate in one direction only, depending on the absence or presence of an actuating voltage, independent of its polarity, as previously discussed.

As will be appreciated from the above description of the present invention, a coil structure is presented which permits a reduced voltage level to be employed as the input voltage while permitting the same sized switch housing or package to be employed as with a full voltage value switch of the prior art.

It should be understood that the invention is not limited to the exact details of construction shown and described herein for obvious modifications will occur to persons skilled in the art.

I claim:

1. A coil assembly for an electromagnetic switch comprising:

a single plunger connected to switch contacts which make and break electrical connections;

a coil having a plurality of coaxial segments mounted on a solenoid surrounding the plunger; and input means respectively connected in parallel to all the oil segments which simultaneously inputs an identical voltage of the same polarity to each segment for generating respective superposed electromagnetic forces that magnetically drive the plunger in a predetermined translational direction.

2. A method for reducing the level of voltage required to electromagnetically actuate switch contacts comprising the steps:

assembling a plurality of coaxially spaced coil segments onto a single switch plunger;

connecting terminals of the segments in parallel across a voltage source having a first output voltage thus causing an identical current to flow through each coil segment;

subjecting the switch contacts to simultaneous superposed e.m.fs. from the individual segments, equivalent to the e.m.f. produced from a voltage level, higher than that of the source, connected across a continuous coil having the same total number of turns as the individual segments, the source voltage being equal in value to the higher voltage value divided by the number of coil segments.

* * * * *

UNITED STATES PATENT AND TRADEMARK OFFICE

CERTIFICATE OF CORRECTION

PATENT NO. : 5,204,646

DATED : April 20, 1993

INVENTOR(S) : Arthur Fleming-Dahl

It is certified that error appears in the above-identified patent and that said Letters Patent is hereby corrected as shown below:

Column 1, line 64, change "operation" to --operating--.

Column 2, line 45, change "at" to --art--.

Column 4, line 9, change "oil" to --coil--.

Signed and Sealed this

Fourth Day of January, 1994

*Attest:*

*Attesting Officer*

Bruce Lehman

BRUCE LEHMAN

*Commissioner of Patents and Trademarks*